US005104161A

United States Patent [19]

Kautt

[11] Patent Number: 5,104,161

[45] Date of Patent: Apr. 14, 1992

[54] FITTING FOR MAINTAINING A LEAF IN A PARTIALLY OPEN POSITION

[75] Inventor: Jean-Jacques Kautt, Strasbourg, France

[73] Assignee: Ferco International Usine de Ferrures de Batiment, Sarresbourg, France

[21] Appl. No.: 619,078

[22] Filed: Nov. 28, 1990

[30] Foreign Application Priority Data

Dec. 9, 1989 [FR] France ..... 89 17024

[51] Int. Cl.[5] ..... E05D 11/06

[52] U.S. Cl. ..... 292/157; 292/DIG. 11; 16/330

[58] Field of Search ..... 292/156, 157, DIG. 11; 16/326-332, 351, 353

[56] References Cited

U.S. PATENT DOCUMENTS

| | | | |
|---|---|---|---|
| 294,746 | 3/1884 | Straup et al. | 16/330 |
| 769,035 | 8/1904 | Walter | 16/330 |
| 771,608 | 10/1904 | Chaffee | 16/330 |
| 975,097 | 11/1910 | Wright | 16/330 |
| 1,078,002 | 11/1913 | Schrey | 16/330 |
| 1,429,416 | 9/1922 | Fade | 16/330 |
| 1,465,912 | 8/1923 | Jensen | 16/330 |
| 1,707,628 | 4/1929 | Donosa | 16/330 |
| 1,946,837 | 2/1934 | Clayton | 16/330 |
| 2,045,837 | 6/1936 | Creber | 16/353 |
| 2,097,651 | 11/1937 | Stangeland | 16/330 |

FOREIGN PATENT DOCUMENTS

| | | | |
|---|---|---|---|
| 642116 | 8/1928 | France | 16/351 |
| 2250373 | 5/1975 | France | 16/353 |
| 426780 | 4/1938 | United Kingdom | 16/351 |
| 1431673 | 4/1976 | United Kingdom | 16/353 |
| 1555317 | 11/1979 | United Kingdom | 16/351 |

*Primary Examiner*—Eric K. Nicholson

*Attorney, Agent, or Firm*—Sandler, Greenblum, & Bernstein

[57] ABSTRACT

Fitting for a door, window or the like comprising locking elements provided with at least one operating rod allowing the actuation of a mechanism for locking the leaf in rotation, in various angular positions, with respect to the sash-frame. This mechanism is composed of at least a clamping element and an additional member, one of which is made integral with an extension of the operating rod and the other one with the sash-frame. The clamping element and the additional member of the actuation mechanism are located on the rotation axis of the leaf, each comprising slits intended for co-operating with each other when actuating the locking elements. The clamping element further comprising connecting members intended for making same integral with either the sash-frame or the operating rod and with respect to which it can move with a stroke of a length at least equal to the height of its slits. The clamping element also includes a springy pull-off mechanism intended for pushing same back in the direction of the additional member, with the additional member being capable of pivoting about the rotation axis and comprising braking members allowing this pivoting only upon application of a varying intensity driving torque.

16 Claims, 1 Drawing Sheet

FITTING FOR MAINTAINING A LEAF IN A PARTIALLY OPEN POSITION

BACKGROUND OF THE INVENTION

1. Field of the Invention

The invention relates to a fitting for a door, window or the like, comprising locking means provided with at least an operating rod allowing to operate means for locking the leaf in rotation, in various angular positions, with respect to the sash-frame. These means include of at least a clamping organ and a complementary member, one of which is made integral with an extension of the operating rod and the other one with the sash-frame.

2. Discussion of the Background Material

Generally, fittings for doors, windows or the like comprise hinging means ensuring the pivoting connection of the leaf to the sash-frame, at the level of their rear stiles. These fittings are furthermore provided with locking means one function of which is to keep the leaf closed against the sash-frame or, on the other hand, to allow the opening of the door, window or the like. In some cases, these locking means are also intended to allow the selection of the way of opening of the leaf, for example, in the French way of hinging.

Thus, said locking means are usually comprised of an operating mechanism onto which acts the user by means of either an operating knob or a key member with a view to actuating a locking member or even one or several operating rods simultaneously acting onto several locking members. In this latter case, the operating rods are frequently arranged in a groove provided for in the periphery of the leaf. As regards the locking members, these are brought to cooperate with keepers accordingly arranged onto the sash-frame.

The selection of the way of opening of the door, window or the like is frequently obtained by means of the operating rods. These latter then act onto the hinging means and, more particularly, onto the folding-arm bearing ensuring the upper connection between the sash-frame and the leaf and eventually allowing the pivoting of same about a horizontal axis.

Thus, one understands that such fittings allow an easy operation of the door, window or the like; it should however be appreciated that although it is easy to lock the leaf against the sash-frame, the user experiences some trouble in ensuring the maintaining in open position of the door or window. A slightest draught can indeed close same or confer to the leaf a certain banging and, in such circumstances, the noise caused by the clash against the sash-frame may prove particularly awkward.

In order to cope with these troubles, it has been foreseen to provide the fittings described above with leaf-stop means which are, for example, in the form of a folding-arm connected to the sash-frame and the leaf, which allow the immobilization of the latter in rotation with respect to the former, in various angular positions.

Of course, although such means allow to cope with the aforementioned troubles, they do however require an additional operation by the user who, at the end, will be strongly inclined to use same only occasionally, when by these leaf-stop means are only of little interest.

There is also known a fitting for a door, window or the like, comprising locking means comprised of an operating mechanism located on the front stile of the window and operating rods extending on both sides of this operating mechanism.

As a matter of fact, this fitting is also provided with means intended for ensuring the locking in rotation of the window in various angular positions.

These means are comprised, more particularly, of a casing inserted onto the sash-frame and, more specifically, near the rotation axis of the window. Inside this casing vertically slide, at the level of its lower face, a series of embosses intended for co-operating with a screw passing through the casing, so as to lock the window in rotation.

It should be noted that said clamping organ is made integral with an operating rod vertically extending above the aforementioned casing and comprising its upper part made integral, by means of an adequate connection, with the rear end of a pivoting lever. More particularly, the pivoting lever is pivotably mounted about a horizontal axis and by means of a strap onto the upper stile of the window or the like. Its front end is, furthermore, made integral with the upper end of the operating rod extending above the operating mechanism. Thus, under the action of same, when controlling the opening, the operating rod is lowered, which causes to confer an ascending motion to the operating rod corresponding to the means for locking in rotation. The clamping element, in the form of a disc provided with embosses, is then lifted in its casing and, finally, released from the screw passing through this latter. Furthermore, one should appreciate the presence of springy pull-off means which get interposed between the upper side Plate of the casing and the clamping element in order to push back same in the direction of the screw. As a matter of fact, such springy pull-off means tend to facilitate the operation consisting, through the operating mechanism, in locking in rotation the window or the like. In fact, although such means for locking the leaf in rotation with respect to the sash-frame offer the advantage of an easy and simple operation through the locking means for the door or window, they do notwithstanding have a number of disadvantages.

Namely, when these means for locking in rotation are brought into active position, it is, of course, no longer possible to close the leaf without previously actuating the locking means. Now, if one inadvertently tries to close the door or window in such circumstances, this unavoidably leads to the deterioration of the fitting.

On the other side, it should be appreciated that in case the locking means are actuated while the recesses defined by the embosses the disc forming the clamping element is comprised of are not in front of the screw passing through the casing in which slides this clamping element, the action onto the locking means cannot be complete and, above all, the expected result will not be achieved. Therefore, and due to the leaving of the person having actuated the door or the window, this latter will keep on banging just as before. In such case, the solution of course consists in looking for the angular position of the leaf which can be locked in rotation by the means described above. As a matter of fact, one turns back to the situation set forth above in relation to the known leaf-stop means, i.e. the user will be inclined to use the clamping means only occasionally.

Thus, the object of this invention is to cope with all the above-mentioned problems. The present invention solves the problem by in providing a fitting for a door, window or the like, comprising locking means provided with at least one operating rod allowing to actuate means for locking the leaf in rotation, in various angular positions, with respect to the sash-frame, these means being comprised of at least a clamping element and an additional member one of which is made integral with an extension of the operating rod and the other one with the sash-frame;

Furthermore:

a) the clamping element and the additional member are located on the rotation axis of the leaf, each comprising slits intended for cooperating with each other in case of locking in rotation of the leaf controlled by the locking means;

b) the clamping element comprises connecting means capable of making same integral with either the sash-frame or the extension of the operating rod and allowing to same a stroke, on the rotation axis of the leaf and with respect to the sash-frame or the extension of the operating rod, of a length at least equal to the height of its slits, this clamping element being also subjected to springy pull-off means intended for pushing same back in the direction of the additional member;

c) the additional member comprises connecting means intended for making same integral with either the sash-frame or the extension of the operating rod and having means allowing the pivoting of the additional member about the rotation axis of the leaf and braking means allowing this pivoting only upon application of a varying intensity driving torque.

As a matter of fact, thanks to the peculiar features of these clamping means, same have a very convincing interest, compared to the leaf-stop means designed hitherto, in that the user will not be adverse to using them as often as possible.

Furthermore, through this invention, these clamping means are particularly safe and reliable. Even in case the clamping element would not be capable of co-operating with the additional member by means of their respective slits, the actuation onto the locking means can indeed occur to a full extent. Then, a slightest angular movement of the leaf caused, for example, by a draught will be enough for said clamping element and, namely, its slits, to be finally pushed back, by springy pull-off means, into those of the additional member and to achieve the desired immobility of the leaf.

BRIEF DESCRIPTION OF THE DRAWINGS

This invention will be better understood with reference to the attached drawing.

DETAILED DESCRIPTION OF THE PREFERRED EMBODIMENTS

Figure 1:
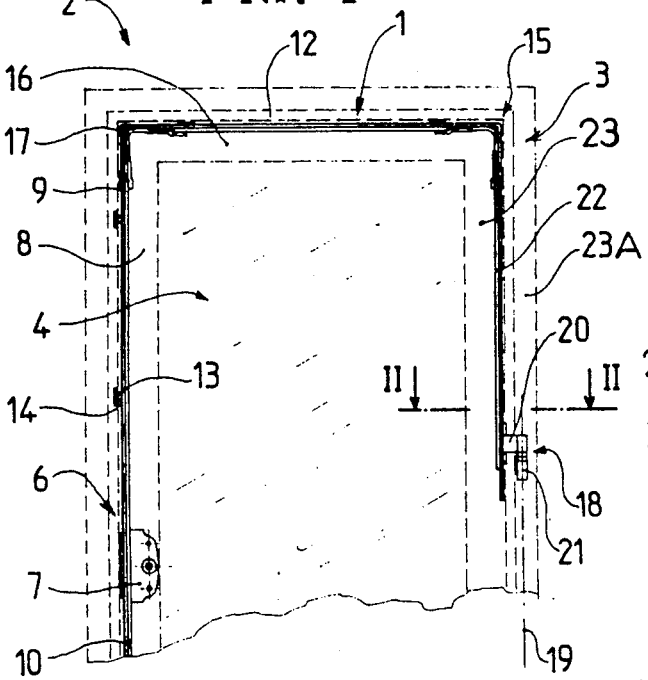
FIG. 1 is a schematic plan view of a window fitted with a fitting according to the invention.

This invention, as shown in FIG. 1, relates to a hinge 1 for a door, window or the like 2 comprised of a sash-frame 3 and a leaf 4.

In fact, besides the hinging means (not shown) connecting this leaf 4 with the sash-frame 3, this fitting 1 comprises locking means 6. Locking means 6 are composed of an operating mechanism 7 generally integrated into the front stile 8 of the leaf 4 and onto which the user can act by means of an operating knob or handle.

This locking mechanism 6 is also provided with at least one operating rod 9, 10, eventually inserted into a groove 11 (see FIG. 2), provided for in the periphery 12 of the leaf 4, these operating rods act, for example, onto locking members 13, such as rollers, catches or the like, capable of co-operating with keepers 14 accordingly arranged on the sash-frame 3.

Furthermore, it should be appreciated that the actuation of the operating rods 9, 10 by means of the operating mechanism 7 can also allow the selection of the way of opening of the door, window or the like, for example, hinging or in the French way. In these circumstances, these operating rods 9 act, namely, onto the hinging means arranged in the upper corner 15 of the door or window. Hence, the operating rod 9 is frequently extended, at the level of the upper rail 16 of the leaf 4, through a bevel gear 17.

This fitting 1 furthermore comprises, as shown in the various figures, clamping means 18 capable of being actuated by locking means 6 in order to immobilize the leaf 4 in rotation and in any angular position with respect to the sash-frame 3.

Such clamping means 18 thus allow to impede the leaf 4 from closing against the sash-frame 3 without such being user's wish.

Advantageously, these clamping means 18 are located on the rotation axis 19 of the leaf 4 and are, preferably, comprised of two distinct parts 20, 21 located on a same axial extension, one part 20 of which is made integral with an extension 22 of the operating rod 9, at the level of the rear stile 23 of said leaf 4, the second part 21 being inserted onto the sash-frame 3 and co-operating with the part 20 when keeping the door, window or the like in half-open position is to be ensured.

Thus, these clamping means 18 are comprised of a clamping element 27 made integral, by adequate connecting means 24, with either the sash-frame 3 or the extension 22 of the operating rod 9. Besides, the clamping means 18 comprise an additional member 28 which, according to the case, will be secured, also by adequate connecting means, either at the level of the extension 22 of the operating rod 9 or onto the sash-frame 3.

The various figures of the drawing attached hereto relate to an embodiment according to which the clamping element is, more particularly, made integral with the extension 22 of the operating rod 9, whereas the additional member is located on the sash-frame of the door or window. The further description will relate to such an embodiment. However, one should always bear in mind that a reverse arrangement of this clamping element 27 and the additional member 28 can be obtained.

Thus and in these circumstances, the connecting means, which connect clamping element 27 to this extension 22 of the operating rod 9, are preferably comprised of a knuckle 24 made integral, by means of a blade 25, with the extension 22 of the operating rod 9. This knuckle 24 has a central bore 26 the axis of which coincides with the rotation axis 19 of the leaf 4.

Figure 2:
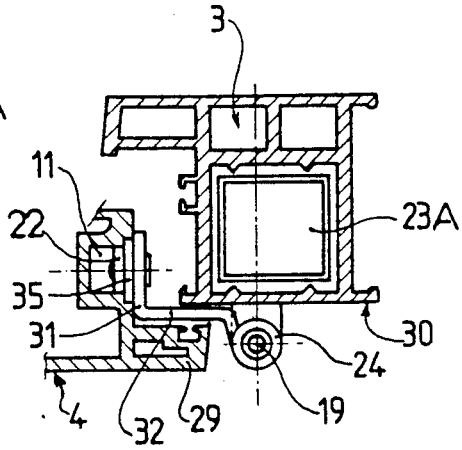
FIG. 2 is a schematic and sectional view according to II—II of FIG. 1.

Subsidiary, it should be appreciated that, as shown in FIG. 2, the leaf 4 may partially overlap the sash-frame 3 and, in such case, it comprises a peripheral rim 29 applying, in closed position, against the internal face 30 of the sash-frame 3.

Hence, it is preconized, in these circumstances, to confer to the blade 25 a square-shape, so as to define two wings 31, 32 the wing 31 is inserted onto the extension 22 of the operating rod 9, and this by means of connecting elements 33 passing through an elongated opening 34 provided for in a headpiece 35 covering the peripheral groove 11. The other wing 32 of this blade 25 protrudes from the fillister of the door, window or the like, so as to position the knuckle 24 provided therein with on the rotation axis 19.

As regards the clamping element 27, this is preferably in the form of a disc 36 provided with slits 37 and made integral with the end 38 of a spindle 39 capable of sliding in the bore 26 of the knuckle 24. Thus, by actuating the operating mechanism 7 so as to bring same into locking position, the extension 22 of the operating rod 9 lowers, thereby driving the knuckle 24. This results in the cooperation of the slits 37 of the disc 36 with the slits 40 of a second disc 41 corresponding to the additional member 28 which is actually located in a same axial extension and, thus, on the rotation axis 19 of the leaf 4.

Figure 4:
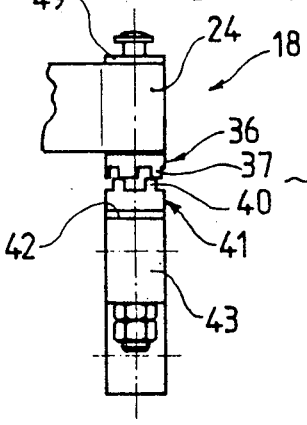
FIG. 4 is a schematic and elevational view of the clamping means brought back into their active position.

However, and as shown in FIG. 4, the slits 37, 40, of the clamping organ 27 and the additional member 28, respectively, are not located symmetrically with respect to each other when the user actuates the locking means 6 to immobilize the leaf 4 in half-open position. Now, in such circumstances, the desired object, i.e. the immobility of the leaf with respect to the sash-frame, is in no way achieved. Furthermore, when this situation occurs when locking the door, window or the like, it should be avoided that the action onto the operating mechanism 7 be limited, as a matter of fact, because of the superposition of the slits 37, 40, which would finally result into a partial locking of this door, window or the like.

In order to cope with the aforementioned troubles, the clamping organ 27 is allowed, through its connecting means 24 which connect same with either the sash-frame 3 or the extension 22 of the operating rod 9, to move, with a stroke 45, on the rotation axis 19 of the leaf 4 and this with respect to the sash-frame 3 or the extension 22 of the operating rod 9. The length of this stroke 45 is at least equal to the height 46 of the slits 37 of this clamping element 27. As regards the movability of same through the connecting means, it is achieved, more particularly, by slidingly mounting the spindle 39, corresponding to this clamping element 27, into the bore 26 of the knuckle 24. In addition, the disc 36, provided with the slits 37 and forming this clamping element 27, keeps, with the face 44 of this knuckle 24, a distance 45 at least equal to the height 46 of the slits 37, from which distance actually results the allowed stroke of this clamping element 27, with respect either to the sash-frame 3 or to the extension 22 of the operating rod 9.

One should furthermore appreciate the presence of springy pull-off means 47 intended for pushing back this clamping element 27 towards the additional member 28 and, thus, for maintaining the disc 36 at a distance with respect to the knuckle 24.

As shown in FIG. 2, these springy pull-off means 47 are preferably formed by means of a helical spring engaged onto the spindle 39 and co-operating, at the level of its ends, on the one hand, with the disc 36 and, on the other hand, with a side plate 49 closing the bore 26 of the knuckle 24, at the level of its one end and, in the case of the embodiment shown in the figures, at the level of its upper part.

Figure 3:
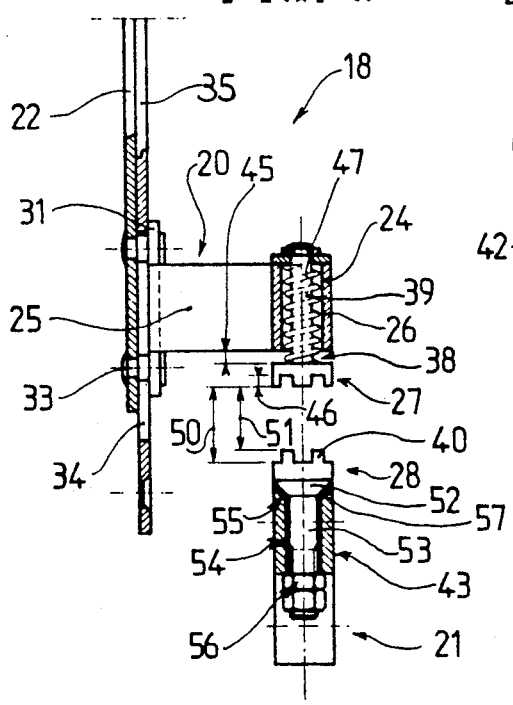
FIG. 3 is a schematic and partly cross-sectional view of the means for locking the leaf in rotation with respect to the sash-frame, the means being shown in a position out of use.

Thus, starting from the unlocked position, as shown in FIG. 3, the user actuates the operating mechanism 7, which results in a stroke 50 of the operating rod 9, repercuted at the level of the extension 22 and, hence, onto the clamping element 27 which approaches the additional member 28.

In the event the slits 37 and 40 of the discs 36 and 41, respectively, do not engage into each other, which situation is shown in FIG. 4, the stroke 50 of the operating rod 9 is larger than the distance 51 kept between the tops of the slits 37 and 40. These latter then push back the former, causing, on the one hand, the disc 36 to near the face 44 corresponding to the knuckle 24 and this, according to the stroke 45, and, on the other hand, the compression of the springy pull-off means 47. A slightest rotation of the leaf 4 with respect to the sash-frame 3 by an amplitude corresponding to the initial angular offset of the slits 37 and 40 results into the engagement of these latter into each other and into the immobilization in rotation of this leaf with respect to the sash-frame.

Figure 5:
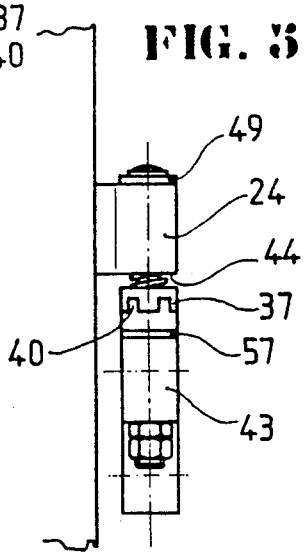
FIG. 5 is a view similar to that of FIG. 4, the clamping means ensuring the immobility in rotation of the leaf with respect to the sash-frame.

This situation is shown, more particularly, in FIG. 5.

Thus, when controlling the closing of the door, window or the like, the user should actuate the operating mechanism 7 in order to bring same back into its unlocked position before controlling the rotation of the leaf 4. However, this user may inadvertently try to cause the leaf 4 to rotate even before having proceeded to the unlocking of the operating mechanism 7. Now, such an action should not result into the deterioration of any component of fitting 1. Thus and according to another embodiment of this invention, the clamping means 18 are, in fact, in the form of means for braking the leaf 4 in rotation with respect to the sash-frame 3.

More exactly, the connecting means 43 of the additional member 28, which allow to make same integral with either the sash-frame 3 or the extension 22 of the operating rod 9, comprise, on the one hand, means allowing this additional member 28 to pivot about the rotation axis 19 corresponding to the leaf 4 and, on the other hand, braking mean which allow this pivoting only by applying a driving torque the intensity of which can be changed. Thus, and according to a preferred embodiment, the connecting means are comprised of a knuckle 43 secured, according to the embodiment shown in the drawings, onto the internal face 30 of the rear stile 23A corresponding to the sash-frame 3. Of course and as already specified above, this knuckle 43 can be made integral with the extension 22 of the operating rod 9, in case of a reversed arrangement.

Besides, the disc 41, provided with its slits 40 and forming the additional member 28, is provided with a truncated base 52 becoming narrower on a spindle 53 passing through a bore 54 provided for in the knuckle 43. This spindle co-operates, at the level of its free end protruding from the knuckle 43, with securing elements 56, such as nuts or the like, capable of keeping same engaged into the knuckle 43. It should be appreciated, furthermore, that the truncated base 52 co-operates, as a valve with its seat, with a mouthpiece 55 having a truncated shape and provided for in the bore 54. Thus, by acting onto the securing elements 56, it is possible to reduce or, at the contrary, increase the pressure with which the truncated base 52 rests against the truncated mouthpiece 55. In fact, the torque which it is convenient to apply onto the disc 41 and, as a consequence, onto the additional member 28 to obtain its rotation is directly proportional to this clamping intensity.

However, it should be appreciated that in case the knuckle 43 and the additional member 28 are made of a metallic-type material, this adjustment can prove particularly difficult. Hence, in such circumstances, it is preconized to interpose, between the truncated base 52 and the mouthpiece 55, a supporting ramp 57 of synthetic material avoiding the friction phenomena. It can also be envisaged to make either the knuckle or the additional member 28 of such a synthetic material.

It is once again stated that the arrangement of the clamping means 18, as described above, can easily be inverted, because no problem arises when fitting the extension 22 of the operating rod 9 with the additional member 28 and associating the clamping element 27 with the sash-frame 3.

In consideration of the features of this invention, the operation in rotation of the leaf 4, even when the clamping means 18 are brought into active position, has no incidence any more onto the operation of these latter.

To conclude, this invention allows to bring an interesting solution for the problems arisen by the keeping in half-open position of the leaf of a door, window or the like, which problems the devices known hitherto have, as a matter of fact, not been able to cope with in a satisfactory way.

I claim:

1. Fitting for a closable opening wherein a leaf is pivotally mounted for rotation about a vertical axis onto a sash-frame, said fitting comprising:

(a) means for locking the leaf against the sash-frame, said means for locking comprising at least one operating rod;

(b) means for locking the leaf in rotation, in various angular positions, with respect to the sash-frame, said means for locking the leaf in rotation comprising:

at least one clamping element and at least one additional member, and means for connecting one of aid at least one clamping element and said at least additional member to said at least one operating rod, and the other of said at least one clamping element and said at least one additional member to the sash-frame, so as to be pivotal about the vertical axis, each of said at least one clamping element and said at least additional member comprising slits and protrusions, said slits and protrusions having a height capable of cooperating with each other to lock said means for locking the leaf in rotation, and said clamping element and said additional member capable of being located on the vertical axis of the leaf, said at least one clamping element having a stroke which is at least equal to the height of its slits and protrusions, and including means for pushing the slits and protrusions on said at least one clamping element towards said at least one additional member, and said additional member including means for braking to permit pivoting of the additional member on the vertical axis upon application of a predetermined driving force; and (c) means for providing cooperation between said means for locking the leaf in rotation and said means for locking the leaf against the sash-frame so that movement of said at least one operating rod actuates said means for locking the leaf in rotation.

2. Fitting according to claim 1, wherein each of said at least one clamping element and said at least one additional member include a disc, and said slits and protrusions are on each disc.

3. Fitting according to claim 2, wherein said means for connecting comprise a knuckle having a bore, a spindle slidingly mounted in said bore to provide the stroke, and the disc containing said slits and protrusions for said at least one clamping element being mounted on one end of said spindle.

4. Fitting according to claim 3, wherein said knuckle is attached to a blade, and said blade includes means for attachment for associating said blade with said at least one operating rod.

5. Fitting according to claim 3, wherein said knuckle includes means for securing to the sash-frame.

6. Fitting according to claim 1, wherein said means for pushing the slits and protrusions on said at least one clamping element towards said at least one additional member comprises a helical spring.

7. Fitting according to claim 6, wherein said helical spring surrounds said spindle.

8. Fitting according to claim 3, wherein said means for pushing the slits and protrusions on said at least one clamping element towards said at least one additional member comprises a helical spring, said helical spring including two ends, one end cooperating with said disc of said at least one clamping element, and a side plate closing said bore of said knuckle with a second end of said helical spring abutting said side plate.

9. Fitting according to claim 2, wherein said means for connecting comprise a knuckle located along the vertical axis, said knuckle having a bore, a spindle slidingly mounted in said bore, and said spindle having one end attached to the disc associated with said at least one additional member.

10. Fitting according to claim 9, wherein the disc associated with said at least one additional member includes a truncated base which becomes narrower in the direction of said spindle, said bore having a truncated portion cooperating with said truncated base.

11. Fitting according to claim 10, wherein said truncated portion is at an upper portion of said bore.

12. Fitting according to claim 10, further including means for varying pressure between said truncated base and said truncated portion.

13. Fitting according to claim 12, wherein said means for varying pressure comprise a free end of said spindle protruding from a lower portion of said bore, and securing elements to vary the pressure.

14. Fitting according to claim 13, further including a supporting ramp between said truncated base and said truncated portion.

15. Fitting according to claim 14, wherein said supporting ramp comprises a synthetic material.

16. Fitting according to claim 13, wherein at least one of said spindle and knuckle comprise a synthetic material.

* * * * *